US007971309B2

(12) United States Patent
Houck

(10) Patent No.: US 7,971,309 B2
(45) **Date of Patent: *Jul. 5, 2011**

(54) SINK DISPOSAL MULTIPURPOSE TOOL

(76) Inventor: Theresa A. Houck, Pueblo, CO (US)

( * ) Notice: Subject to any disclaimer, the term of this patent is extended or adjusted under 35 U.S.C. 154(b) by 535 days.

This patent is subject to a terminal disclaimer.

(21) Appl. No.: 12/069,850

(22) Filed: Feb. 13, 2008

(65) Prior Publication Data

US 2009/0007343 A1 Jan. 8, 2009

Related U.S. Application Data

(63) Continuation-in-part of application No. 11/824,733, filed on Jul. 3, 2007, now Pat. No. 7,480,954.

(51) Int. Cl.
*A47L 25/00* (2006.01)

(52) U.S. Cl. ..... 15/105; 15/236.01; 4/286; 4/295; 81/488

(58) Field of Classification Search ..... 15/105, 15/236.01; 4/286, 293, 295; 81/488; D32/35, D32/40, 42, 46–49
See application file for complete search history.

(56) References Cited

U.S. PATENT DOCUMENTS

| | | | | | |
|---|---|---|---|---|---|
| 285,771 | A * | 9/1883 | Turner | 15/105 |
| 4,268,080 | A * | 5/1981 | Lindley | 294/1.1 |
| 4,297,761 | A * | 11/1981 | Loos | 15/105 |
| 4,409,692 | A * | 10/1983 | Ness | 4/286 |
| 4,504,996 | A * | 3/1985 | Loos | 15/105 |
| D292,835 | S * | 11/1987 | Schaber | D32/35 |
| 5,224,234 | A * | 7/1993 | Arsenault et al. | 15/167.1 |
| 5,404,596 | A * | 4/1995 | Coory | 4/287 |
| 5,617,605 | A * | 4/1997 | Hoerner et al. | 15/105 |
| 2006/0107476 | A1 * | 5/2006 | Mameletzi et al. | 15/105 |

* cited by examiner

*Primary Examiner* — Mark Spisich

(57) ABSTRACT

A sink disposal multipurpose tool is described. Disposals can be damaged by non-food items that are inadvertently dropped therein. A sink disposal multipurpose tool is configured so that it rests within and above a disposal in such a way as to block non-food items from entering a disposal while allowing water and food-waste items entrance. The tool is configured with a plurality of attachments, including a scraper and stuffer blade attachment so that a cook can efficiently scrape food waste materials from dishes, pans, etc. into a sink. The tool can be used to gather the food waste materials from the sink and push them into a disposal. Other attachments include a scrub pad, a brush, and a peeler. The sink disposal multipurpose tool can be returned to its storage position in and above the disposal well where it effectively stops utensils, etc. from entering the disposal unit.

7 Claims, 7 Drawing Sheets

SINK DISPOSAL MULTIPURPOSE TOOL

CROSS-REFERENCE TO RELATED APPLICATIONS

This application is a continuation-in-part of U.S. patent application Ser. No. 11/824,733 now U.S. Pat. No. 7,480,954, entitled "Sink Disposer Stuffer and Scraper Tool" and filed on Jul. 3, 2007, which is specifically incorporated herein by reference for all that it discloses and teaches.

TECHNICAL FIELD

The invention relates generally to the plumbing fixtures industry and more particularly to a multipurpose kitchen tool for sink garbage disposal units.

BACKGROUND

In-sink garbage disposal units have been in existence for the better part of a century. However, many localities were quick to outlaw their use for fear of placing too much strain on the local sewer system. In recent years, many such prohibitions have been lifted and the popularity of garbage disposals has grown dramatically. Nevertheless, as the number of installed disposals continues to grow, a few obvious deficiencies in the general design and usage have become apparent.

Disposals are normally installed under the kitchen sink. The top opening in a disposal is called a "disposal well" and is fitted into the drain opening in the bottom of a sink. The remainder of the disposal unit resides in the cabinet or cupboard below the sink. This lower portion of the disposal includes the blades or other means for chopping or shredding waste food. After the waste food is reduced in size, the disposal pushes it out into an effluent disposal system (i.e., a sewer system).

Garbage disposals provide for a simple and clean method of ridding a house of kitchen waste food materials, including: produce trimmings such as the ends of carrots, after-dinner plate scraps, eggshells, etc. To utilize a garbage disposal, a cook simply places waste food materials into the sink, turns on the tap so that water is flowing into the disposal and pushes the waste food into the disposal well. The cook then turns the disposal unit on and continues to feed the waste food into the disposal well. When the disposal has sufficiently chopped or shredded the waste food, the cook then shuts the disposal off and turns off the flow of tap water. The processed waste food is flushed out of the disposal and into the drain system by the flow of water.

One common problem with disposals is that the opening in the disposal well is usually large enough to allow non-waste food items to enter the disposal. Items such as eating utensils, kitchen knives, etc. often fall into the disposal well and can cause both significant damage to the disposal and can be damaged by the disposal when the unit is turned on. Placing a rubber stopper or other device over the disposal well can reduce such accidents, but stopper devices also can impede the flow of water and waste food into the disposal well. Although some stopper devices attempt to address this problem by providing drainage holes or waste food openings, the design of such devices often allows non-waste food items to enter the disposal well.

Additionally, current sink disposal stoppers can be difficult to insert and remove from the disposal well and are most often completely useless for otherwise assisting a cook in his or her food-preparation and kitchen cleaning tasks. Therefore, there is a need for a sink disposal tool that allows waste food and water to enter a disposal well while denying entry to utensils and other similar items; that is easy to install and remove from a disposal well; and that can be utilized by a cook or other person to assist him or her with other kitchen tasks.

SUMMARY

Embodiments described and claimed herein address the foregoing problems by providing a sink disposal multipurpose tool. The tool has an upper portion having an outer diameter that allows it to be stored, and be carried, on and above the inside lip on the sink collar where the sink drain meets the disposal well on a garbage disposal unit. Alternatively, in another embodiment, the tool is carried and stored on the split rubber entry portion of the disposal well. The outer lower peripheral portion of the upper portion of the tool can be fluted or otherwise shaped so as to facilitate drainage and funnel smaller pieces of food from the sink into the disposal while the tool is in the storage position. Because the surrounding space between the large outer diameter of the tool and the disposal well is not appropriately sized or shaped to comfortably contain a cook's fingers, the tool includes a top knob so that it may be conveniently lifted from within the disposal well.

The central portion of the tool is shaped so as to fit within the well of a disposal. The shape allows a cook to push waste food down into the disposal well without risking injury to his or her fingers. The tool can be manufactured such that its surface is non-slip to enhance its usability and it can be made dishwasher safe. Furthermore, the surface will not allow build up of bacteria or grease.

Additionally, the tool can be configured with a number of attachments that fit onto the lower portion of the tool. For example, a blade-shaped device can be affixed to the tool to assist a cook in scraping waste food off of dishes and into the disposal well. Numerous other attachments are contemplated, including, but not limited to: a brush, a peeler, and a scrub pad.

BRIEF DESCRIPTION OF THE DRAWINGS

The aforementioned and other features and objects of the present invention and the manner of attaining them will become more apparent and the invention itself will be best understood by reference to the following description of a preferred embodiment and other embodiments taken in conjunction with the accompanying drawings, wherein.

DETAILED DESCRIPTION

In one embodiment, a sink disposal multipurpose tool is configured with a scraper and stuffer blade attachment so that a cook or other user of the tool can efficiently scrape food waste materials from dishes, pans, etc. into a sink. The tool can then be used to gather the food waste materials from the bottom of the sink and push them into a drain opening in the sink. As food waste material is pushed through the sink drain opening, it enters the disposal well. The tool helps the cook to push food waste materials through the split rubber entry portion of the disposal. The disposal is then activated and the food waste materials are shredded and flushed out of the disposal into the waste water handling system. The sink disposal multipurpose tool can then be returned to its rest position in and above the disposal well where it effectively stops utensils, etc. from entering the disposal unit.

Figure 1:
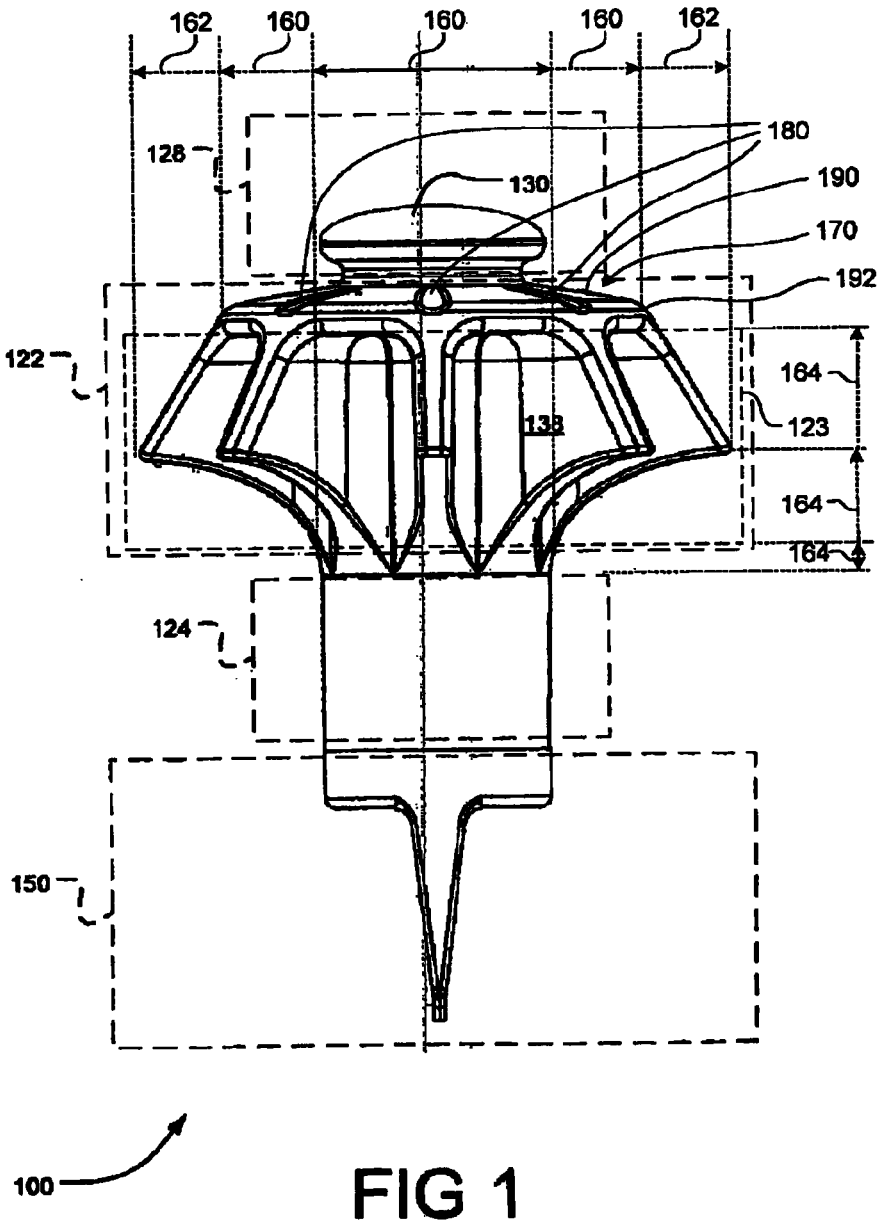
FIG. 1 illustrates a side view of an exemplary embodiment of a sink disposal multipurpose tool including a scraper and stuffer attachment blade.

FIG. 1 illustrates a side view of an exemplary embodiment of a sink disposal multipurpose tool 100. This particular embodiment includes a scraper and stuffer attachment blade 150. The body of the tool as illustrated in FIG. 1 includes an upper portion 122 having a bottom portion sized to generally extend beyond the diameter of the drain opening in the bottom of a sink so that the tool 100 can be carried/ stored on and above the sink collar or drain opening in a sink. In other embodiments, other storage locations and means are contemplated.

The body of the tool 100 also has a push portion 124 extending centrally beneath the upper portion 122, configured to push food through the sink collar and into the disposal. The lower body of the tool 100 can be configured with a myriad of attachments. The attachment shown in FIG. 1 is a singular blade portion 150 extending across and beneath the push portion 124 for scraping food from dishes and sinks into the disposal. Other attachments are contemplated.

Additionally, FIG. 1 illustrates a top lift means 128 extending centrally above the upper portion 122 so that the tool 100 can be lifted up and out of a storage position in the sink drain. The top lift means 128 displayed in FIG. 1 utilizes a knob 130. Other means of lifting the tool 100 are contemplated in other embodiments.

The push portion 124 can be generally cylindrical in shape so that it loosely fills the sink drain and the disposal well. In other embodiments, various shapes and sizes are contemplated for the push portion 124 so that it loosely fits variously shaped and sized sink drains and disposal wells.

In one embodiment, the blade portion 150 is manufactured from a flexible rubber or plastic to better facilitate scraping of waste food from curved portions of dishes and sinks. In another embodiment, the blade portion 150 is made using some other material(s). It is also contemplated that the size and shape of the blade portion 150 may vary without departing from the scope of the invention.

In the embodiment illustrated in FIG. 1, the outer lower peripheral portion of the upper portion 122 is fluted 138 there-around to facilitate drainage and funnel smaller pieces of waste food material from the sink into the disposal. In other embodiments, other shapes may be utilized besides fluting to direct waste material into the disposal.

Figure 2:
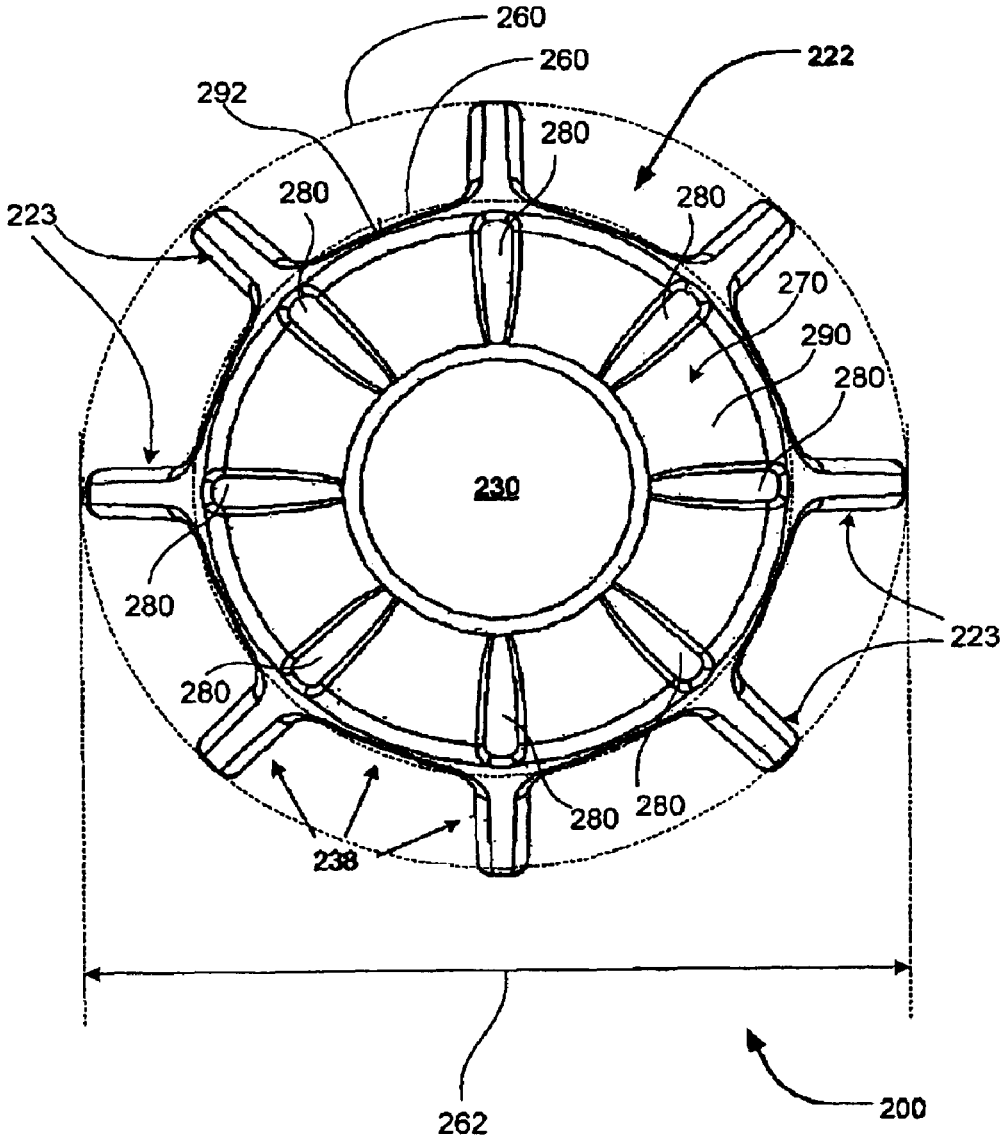
FIG. 2 illustrates a top view of an exemplary embodiment of a sink disposal multipurpose tool.

FIG. 2 illustrates a top view of an exemplary embodiment of a sink disposal multipurpose tool 200. In the view shown in FIG. 2, the top lift means is a knob 230 extending centrally above the upper portion 222 so that the tool 200 can be lifted up and out of a storage position in the sink drain. Other means of lifting the tool 200 are contemplated in other embodiments.

In the top view illustrated in FIG. 2, the fluting 238 of the upper portion can be clearly seen. The fluting 238 is designed to facilitate drainage and funnel smaller pieces of waste food material from the sink into the disposal. In other embodiments, other shapes may be utilized besides fluting to direct waste material into the disposal.

Figure 3:
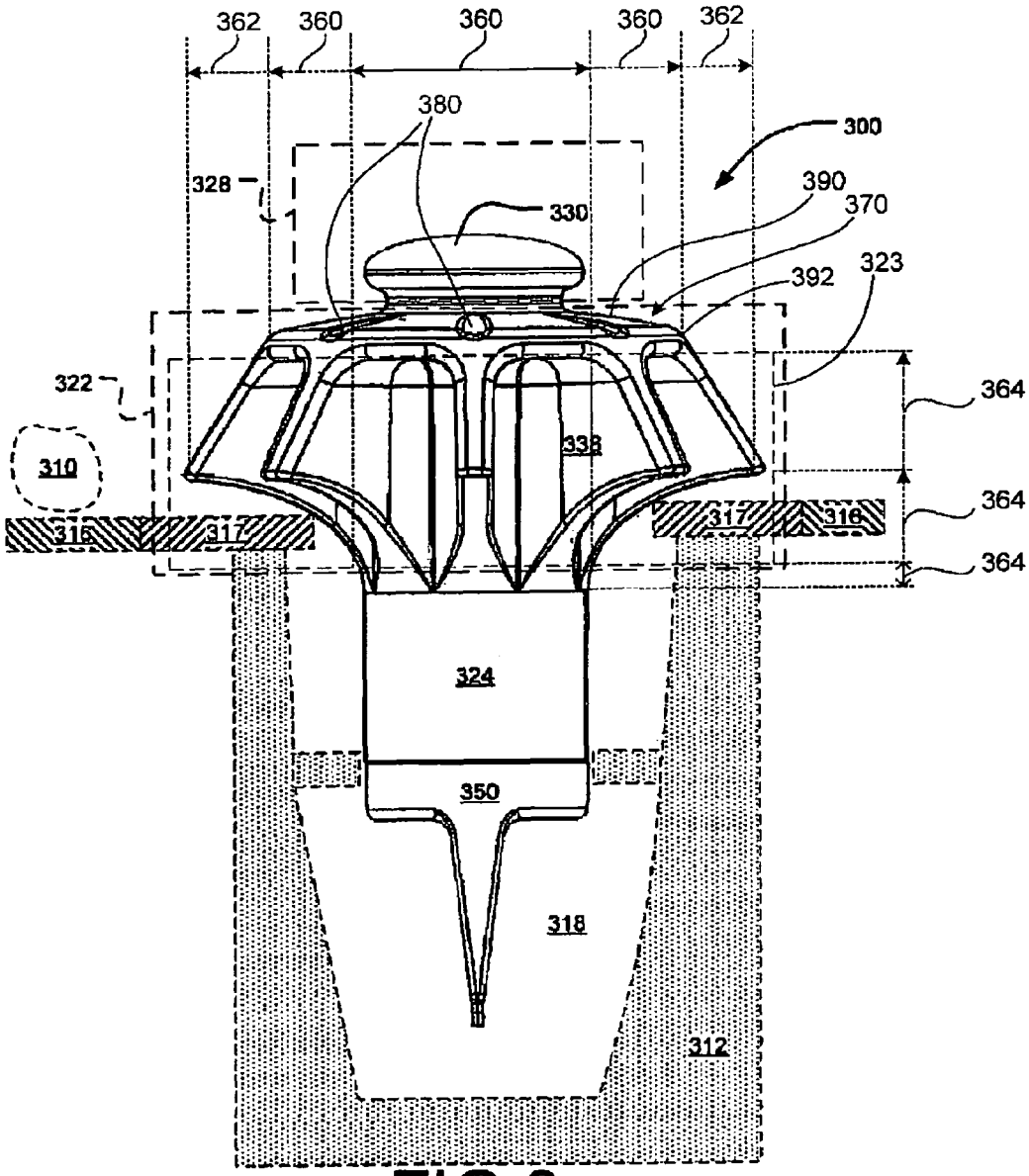
FIG. 3 illustrates a side view of an exemplary embodiment of a sink disposal multipurpose tool including a scraper and stuffer attachment blade in an exemplary rest position on and above a sink drain collar.

FIG. 3 illustrates a side view of an exemplary embodiment of a sink disposal multipurpose tool 300 including a scraper and stuffer attachment blade 350 in an exemplary rest position on and above a sink drain collar 317. This particular embodiment includes a scraper and stuffer attachment blade 350. The body of the tool as illustrated in FIG. 3 includes an upper portion 322 having a bottom portion sized to generally extend beyond the diameter of the drain opening in the bottom of a sink 316 so that the tool 300 can be carried/stored on and above the sink collar 317 or drain opening in a sink 316. The body of the tool 300 also has a push portion 324 extending beneath the upper portion 322, configured to push waste food 310 through the sink collar 317 and into the disposal 312.

The lower body of the tool 300 can be configured with a myriad of attachments. The attachment shown in FIG. 3 is a singular blade portion 350 extending across and beneath the push portion 324 for scraping food 310 from dishes and sinks 316 into the disposal 312. Additionally, FIG. 3 illustrates a top lift means 328 extending centrally above the upper portion 322 so that the tool 300 can be lifted up and out of a storage position in the disposal well 318. The top lift means 328 displayed in FIG. 3 utilizes a knob 330. Other means of lifting the tool 300 are contemplated in other embodiments.

The push portion 324 can be generally cylindrical in shape so that it loosely fills the sink drain and the disposal well 318. In other embodiments, various shapes and sizes are contemplated to loosely fit variously shaped and sized sink drains and disposal wells.

In one embodiment, the blade portion 350 is manufactured from a flexible rubber or plastic to facilitate better scraping of waste food from curved portions of dishes and sinks. In another embodiment, the blade portion 350 is made using some other material(s). It is also contemplated that the size and shape of the blade portion 350 may vary without departing from the scope of the invention.

In the embodiment illustrated in FIG. 3, the outer lower peripheral portion of the upper portion 322 is fluted 338 there-around to facilitate drainage and funnel smaller pieces of waste food material 310 from the sink 316 into the disposal 312. In other embodiments, other shapes may be utilized besides fluting to direct waste material into the disposal 312.

Figure 4:
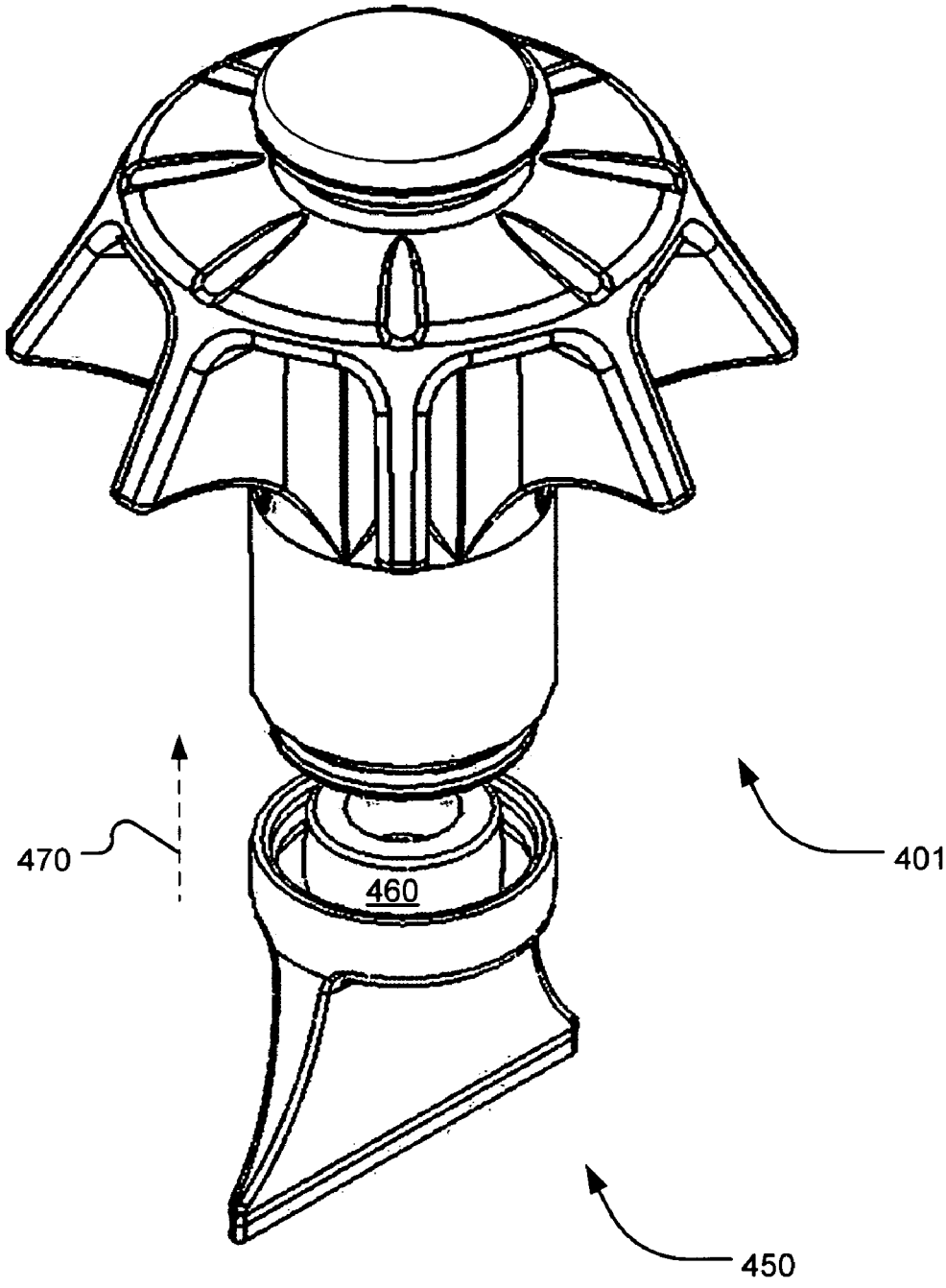
FIG. 4 illustrates a perspective view of an exemplary embodiment of a sink disposal multipurpose tool including an unattached scraper and stuffer attachment blade.

FIG. 4 illustrates a perspective view of an exemplary embodiment of a detached sink disposal multipurpose tool 401 and an unattached scraper and stuffer attachment blade 450. The blade 450 can be pushed in the direction indicated by the up arrow 470 onto the tool 401 to snap the blade attachment means 460 onto the tool 401. The manner of attaching the blade 450 to the tool 401 can vary from that shown in FIG. 4 without departing from the scope of the invention. For example, in an alternate embodiment, the blade 450 could screw onto the tool 401.

Figure 5:
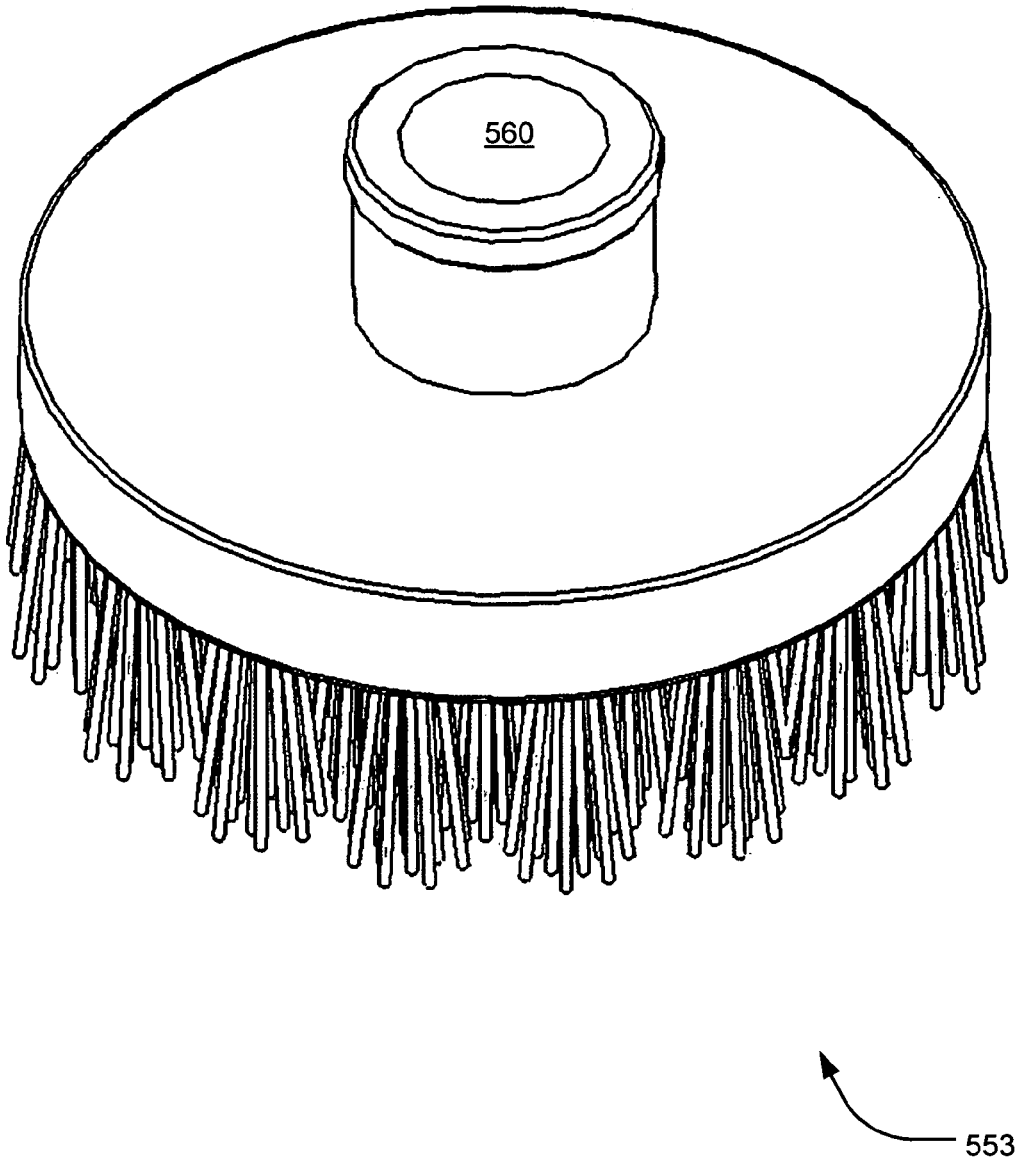
FIG. 5 illustrates a perspective view of an exemplary embodiment of a brush attachment for a sink disposal multipurpose tool.

FIG. 5 illustrates a perspective view of an exemplary embodiment of a brush attachment 553 for a sink disposal multipurpose tool. The brush 553 has a brush attachment means 560 that allows the brush 553 to attach to the tool. In other embodiments, the size and shape of the brush attachment means 560 varies from that shown in FIG. 5. Furthermore, the means 560 can vary functionally as well, e.g., the brush 553 could be attached to the tool by screwing it onto the base of the tool instead of by using the snap-on attachment means 560 illustrated in FIG. 5.

Figure 6:
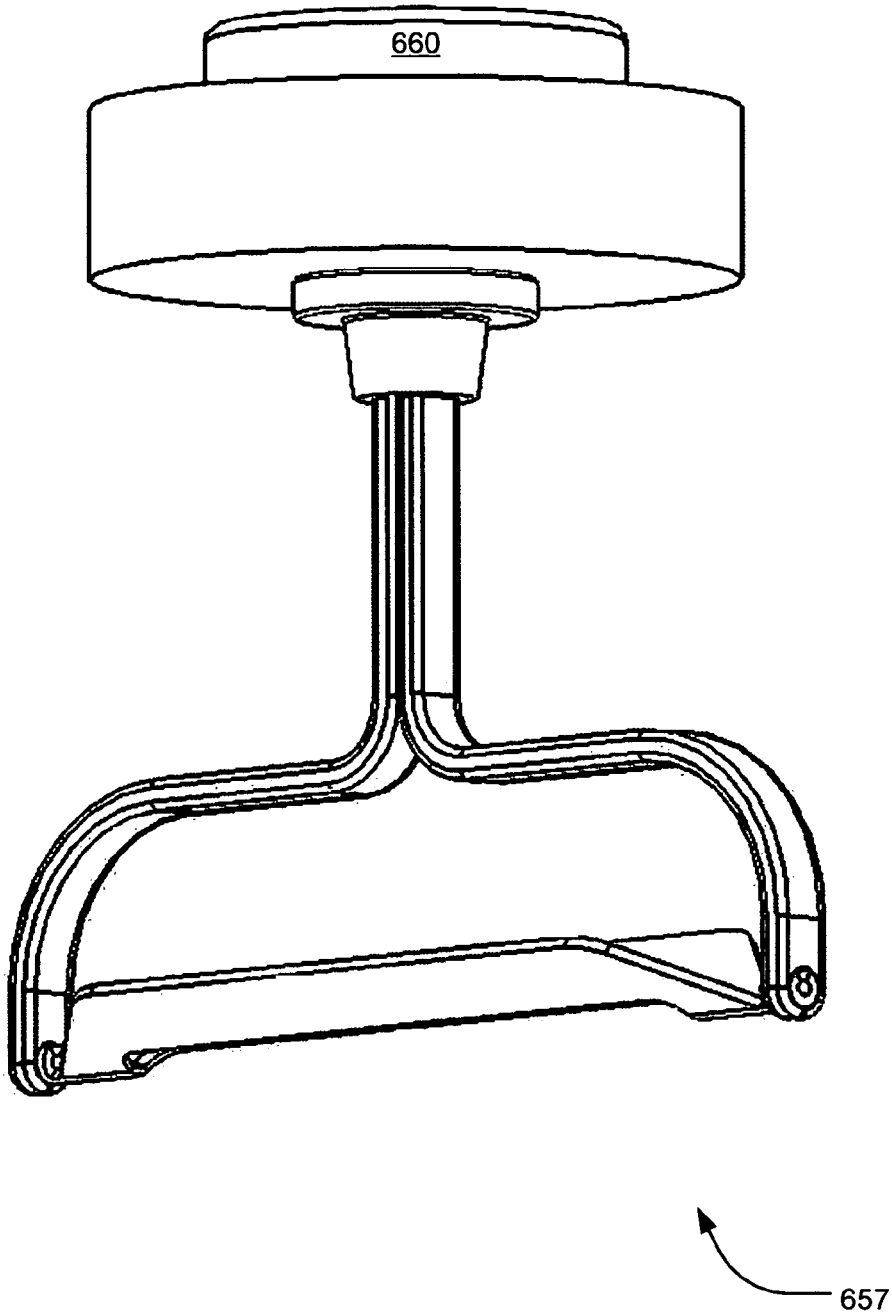
FIG. 6 illustrates a perspective view of an exemplary embodiment of a peeler attachment for a sink disposal multipurpose tool.

FIG. 6 illustrates a perspective view of an exemplary embodiment of a peeler attachment 657 for a sink disposal multipurpose tool. The peeler 657 has a peeler attachment means 660 that allows the peeler 657 to attach to the tool. In other embodiments, the size and shape of the peeler attachment means 660 varies from that shown in FIG. 6. Furthermore, the means 660 can vary functionally as well, e.g., the peeler 657 could be attached to the tool by screwing it onto the base of the tool instead of by using the snap-on attachment means 660 illustrated in FIG. 6.

Figure 7:
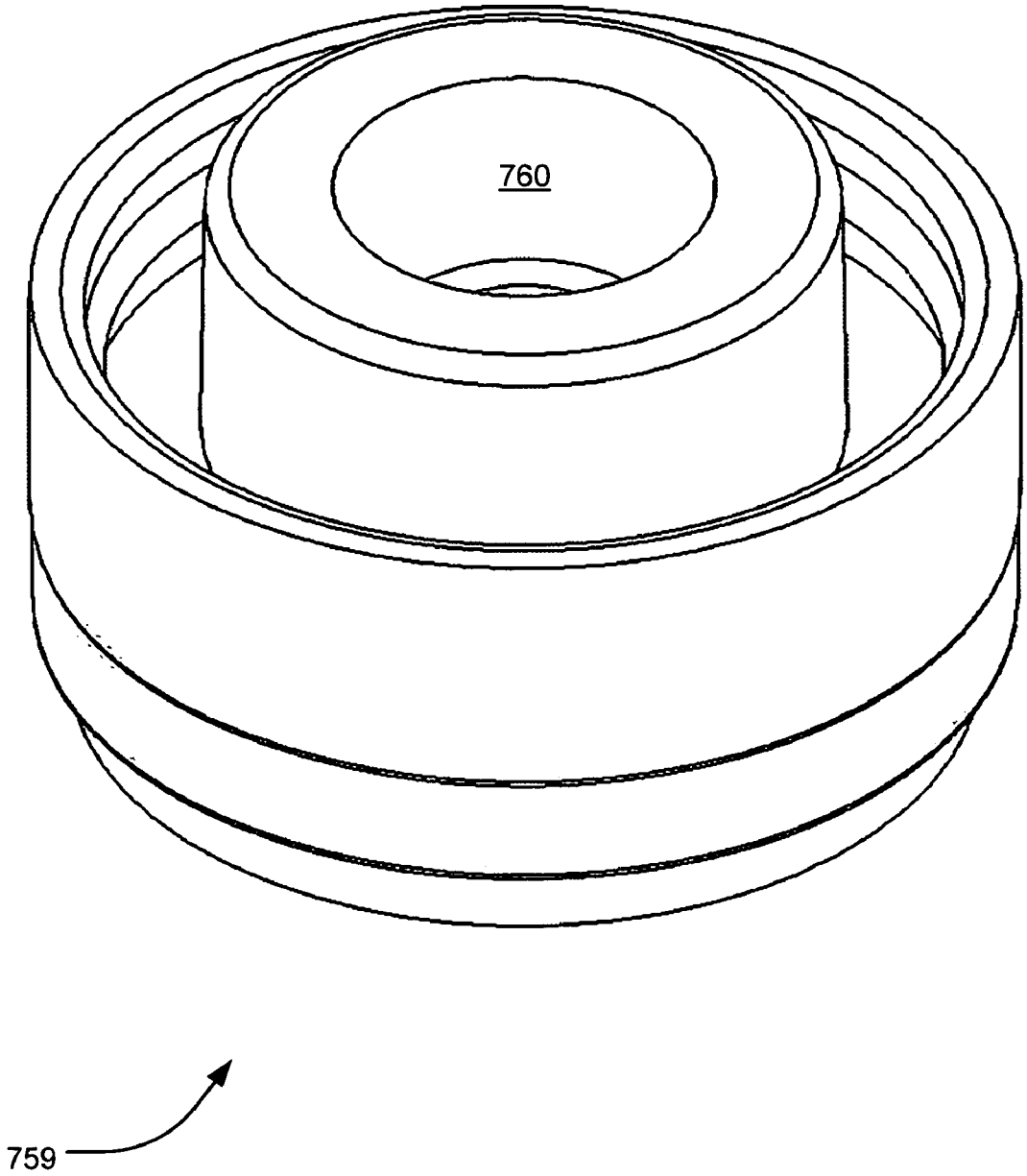
FIG. 7 illustrates a perspective view of an exemplary embodiment of a scrub pad attachment for a sink disposal multipurpose tool.

FIG. 7 illustrates a perspective view of an exemplary embodiment of a scrub pad attachment 759 for a sink disposal multipurpose tool. The scrub pad 759 has a scrub pad attachment means 760 that allows the scrub pad 759 to attach to the tool. In other embodiments, the size and shape of the scrub pad attachment means 760 varies from that shown in FIG. 7. Furthermore, the means 760 can vary functionally as well, e.g., the scrub pad 759 could be attached to the tool by screwing it onto the base of the tool instead of by using the snap-on attachment means 760 illustrated in FIG. 7.

In other embodiments, the tool could be configured with other attachments, either detachable or permanently attached.

The above specification, examples and data provide a description of the structure and use of exemplary embodiments of the described articles of manufacture and methods. Many embodiments can be made without departing from the spirit and scope of the invention.

Referring to FIG. 1, in accordance with at least one embodiment, a sink disposal tool 100 is provided. In accordance with at least one embodiment, the sink disposal tool 100 comprises an upper portion 122 comprising an outer lower peripheral portion 123 fluted 138 around an outside diameter 160. In accordance with at least one embodiment, the sink disposal tool 100 further comprises a push portion 124 extending from the upper portion 122, wherein the outside diameter 160 of the outer lower peripheral portion 123 of the upper portion 122 increases with decreasing distance 164 from the push portion 124 until the outside diameter 160 achieves a maximum diameter 162 then decreases with decreasing distance 164 from the push portion 124. In accordance with at least one embodiment, the sink disposal tool 100 further comprises a lower portion extending from the push portion 124.

In accordance with at least one embodiment, the outside diameter 160 of the outer lower peripheral portion 123 of the upper portion 122 of the sink disposal tool 100 increases linearly with decreasing distance 164 from the push portion 124 until the outside diameter 160 achieves the maximum diameter 162. In accordance with at least one embodiment, the upper portion 122 of the sink disposal tool 100 further comprises a circular portion 170, the circular portion 170 defining radially disposed channels 180. In accordance with at least one embodiment, a number of the radially disposed channels 180 is equal to a number of flutes 138 of the outer lower peripheral portion 123. In accordance with at least one embodiment, the circular portion 170 comprises an upper surface 190. In accordance with at least one embodiment, the upper surface 190 is a convex surface. In accordance with at least one embodiment, the radially disposed channels 180 are concavely defined in the upper surface 190. In accordance with at least one embodiment, the upper portion 122 of the sink disposal tool 100 comprises an upper surface 190. In accordance with at least one embodiment, the upper surface 190 defines radially disposed concave channels 180.

In accordance with at least one embodiment, the sink disposal tool 100 comprises an upper portion 122 comprising an outer lower peripheral portion 123 fluted 138 around an outside diameter 160 and a circular portion 170, the circular portion 170 defining radially disposed channels 180. In accordance with at least one embodiment, the sink disposal tool 100 further comprises a push portion 124 extending from the upper portion 122. In accordance with at least one embodiment, the sink disposal tool 100 further comprises a lower portion extending from the push portion 124. In accordance with at least one embodiment, a number of the radially disposed channels 180 is equal to a number of flutes 138 of the outer lower peripheral portion 123. In accordance with at least one embodiment, the circular portion 170 comprises an upper surface 190. In accordance with at least one embodiment, upper surface 190 is a convex surface. In accordance with at least one embodiment, radially disposed channels 180 are concavely defined in upper surface 190.

In accordance with at least one embodiment, the sink disposal tool 100 comprises a circular portion 170 comprising an upper surface 190 and a periphery 192, said circular portion 170 coupled to a top lift means 128. The sink disposal tool further comprises a fluted portion 138 disposed below the circular portion 170, the fluted portion 138 defining a plurality of flutes disposed below the periphery 192 of the circular portion 170, the fluted portion 138 extending from the circular portion 170 such that the fluted portion 138 increases in outside diameter 160 farther from the circular portion 170 to a maximum diameter 162, the fluted portion 138 then decreasing in outside diameter 160 from the maximum diameter 162 in a direction away from the circular portion 170. The sink disposal tool 100 further comprises a push portion 124 disposed below the fluted portion 138.

Referring to FIG. 2, in accordance with at least one embodiment, a sink disposal tool 200 is provided. In accordance with at least one embodiment, the sink disposal tool 200 comprises an upper portion 222 comprising an outer lower peripheral portion 223 fluted 238 around an outside diameter 260. In accordance with at least one embodiment, the sink disposal tool 200 further comprises a push portion extending from the upper portion 222, wherein the outside diameter 260 of the outer lower peripheral portion 223 of the upper portion 222 increases with decreasing distance from the push portion until the outside diameter 260 achieves a maximum diameter 262 then decreases with decreasing distance from the push portion. In accordance with at least one embodiment, the sink disposal tool 200 further comprises a lower portion extending from the push portion.

In accordance with at least one embodiment, the outside diameter 260 of the outer lower peripheral portion 223 of the upper portion 222 of the sink disposal tool 200 increases linearly with decreasing distance from the push portion until the outside diameter achieves the maximum diameter 262. In accordance with at least one embodiment, the upper portion 222 of the sink disposal tool 200 further comprises a circular portion 270, the circular portion 270 defining radially disposed channels 280. In accordance with at least one embodiment, a number of the radially disposed channels 280 is equal to a number of flutes of the outer lower peripheral portion. In accordance with at least one embodiment, the circular portion 270 comprises an upper surface 290. In accordance with at least one embodiment, the upper surface 290 is a convex surface. In accordance with at least one embodiment, radially disposed channels 280 are concavely defined in upper surface 290. In accordance with at least one embodiment, the upper portion 222 of the sink disposal tool 200 comprises an upper surface 290.

In accordance with at least one embodiment, the sink disposal tool 200 comprises an upper portion 222 comprising an outer lower peripheral portion 223 fluted 238 around an outside diameter 260 and a circular portion 270, the circular portion 270 defining radially disposed channels 280. In accordance with at least one embodiment, the sink disposal tool 200 further comprises a push portion extending from the upper portion 222. In accordance with at least one embodiment, the sink disposal tool 200 further comprises a lower portion extending from the push portion. In accordance with at least one embodiment, a number of the radially disposed channels 280 is equal to a number of flutes of the outer lower peripheral portion 223. In accordance with at least ones embodiment, the circular portion 270 comprises an upper surface 290. In accordance with at least one embodiment, the upper surface 290 is a convex surface. In accordance with at least one embodiment, the radially disposed channels 280 are concavely defined in upper surface 290.

In accordance with at least one embodiment, the sink disposal tool 200 comprises a circular portion 270 comprising an upper surface 290 and a periphery 292, said circular portion 270 coupled to a top lift means comprising a knob 230. The sink disposal tool further comprises a fluted portion 238 disposed below the circular portion 270, the fluted portion 238 defining a plurality of flutes disposed below the periphery 292 of the circular portion 270, the fluted portion 238 extending from the circular portion 270 such that the fluted portion 238 increases in outside diameter 260 farther from the circular portion 270 to a maximum diameter 262, the fluted portion 238 then decreasing in outside diameter 260 from the maximum diameter 262 in a direction away from the circular portion 270.

Referring to FIG. 3, in accordance with at least one embodiment, a sink disposal tool 300 is provided for use with a sink 316 having a drain opening 317 and a disposal 312. In accordance with at least one embodiment, the sink disposal tool 300 comprises an upper portion 322 comprising an outer lower peripheral portion 323 fluted 338 around an outside diameter 360 to facilitate drainage from the sink 316 into the disposal 312. In accordance with at least one embodiment, the sink disposal tool 300 further comprises a push portion 324 extending from the upper portion 322 and configured to push food 310 through the drain opening 317 and into the disposal 312, wherein the outside diameter 360 of the outer lower peripheral portion 323 of the upper portion 322 increases with decreasing distance 364 from the push portion 324 until the outside diameter 360 achieves a maximum diameter 362 then decreases with decreasing distance 364 from the push portion 324. In accordance with at least one embodiment, the sink disposal tool 300 further comprises a lower portion extending from the push portion 324.

In accordance with at least one embodiment, the outside diameter 360 of the outer lower peripheral portion 323 of the upper portion 322 of the sink disposal tool 300 increases linearly with decreasing distance 364 from the push portion 324 until the outside diameter 360 achieves the maximum diameter 362. In accordance with at least one embodiment, the upper portion 322 of the sink disposal tool 300 further comprises a circular portion 370, the circular portion 370 defining radially disposed channels 380. In accordance with at least one embodiment, a number of the radially disposed channels 380 is equal to a number of flutes 338 of the outer lower peripheral portion 323. In accordance with at least one embodiment, the circular portion 370 comprises an upper surface 390. accordance with at least one embodiment, the upper surface 390 is a convex surface. In accordance with at least one embodiment, radially disposed channels 380 are concavely defined in the upper surface 390. In accordance with at least one embodiment, the upper portion 322 of the sink disposal tool 300 comprises an upper surface 390 defining radially disposed concave channels 380.

In accordance with at least one embodiment, the sink disposal tool 300 comprises an upper portion 322 comprising an outer lower peripheral portion 323 fluted 338 around an outside diameter 360 to facilitate drainage from the sink 316 into the disposal 312 and a circular portion 370, the circular portion 370 defining radially disposed channels 380. In accordance with at least one embodiment, the sink disposal tool 300 further comprises a push portion 324 extending from the upper portion 322 and configured to push food 310 through the drain opening 317 and into the disposal 312. In accordance with at least one embodiment, the sink disposal tool 300 further comprises a lower portion extending from the push portion 324. In accordance with at least one embodiment, a number of the radially disposed channels 380 is equal to a number of flutes 338 of the outer lower peripheral portion 323. In accordance with at least one embodiment, the circular portion 370 comprises an upper surface 390. In accordance with at least one embodiment, the upper surface 390 is a convex surface. In accordance with at least one embodiment, the radially disposed channels 380 are concavely defined in upper surface 390.

In accordance with at least one embodiment, the sink disposal tool 300 comprises a circular portion 370 comprising an upper surface 390 and a periphery 392, said circular portion 370 coupled to a top lift means 328. The sink disposal tool 300 further comprises a fluted portion 338 disposed below the circular portion 370, the fluted portion 338 defining a plurality of flutes disposed below the periphery 392 of the circular portion 370, the fluted portion 338 extending from the circular portion 370 such that the fluted portion 338 increases in outside diameter 360 farther from the circular portion 370 to a maximum diameter 362, the fluted portion 338 then decreasing in diameter 360 from the maximum diameter 362 in a direction away from the circular portion 370. The sink disposal tool 300 further comprises a push portion 324 disposed below the fluted portion 338.

What is claimed is:

1. A sink disposal tool comprising:

a) a circular portion having an upper surface and a periphery, said circular portion coupled to a top lift means;

b) a fluted portion disposed below the circular portion, the fluted portion defining a plurality of flutes disposed below the periphery of the circular portion, the fluted portion extending from the circular portion such that the fluted portion increases in outside diameter farther from the circular portion to a maximum diameter, the fluted portion then decreasing in outside diameter from the maximum diameter in a direction away from the circular portion; and c) a push portion disposed below the fluted portion.

2. The sink disposal tool of claim 1, wherein the outside diameter decreases from the maximum diameter with decreasing distance from the push portion.

3. The sink disposal tool of claim 1, wherein the outside diameter of the fluted portion increases linearly with decreasing distance from the push portion until the outside diameter achieves the maximum diameter.

4. The sink disposal tool of claim 1, wherein the upper surface defines radially disposed channels in the circular portion.

5. The sink disposal tool of claim 4, wherein a number of the radially disposed channels is equal to a number of the plurality of flutes of the fluted portion.

6. The sink disposal tool of claim 4, wherein the upper surface is a convex surface.

7. The sink disposal tool of claim 1, wherein the outside diameter of the fluted portion increases linearly.

* * * * *